US006420657B1

(12) United States Patent
Fang et al.

(10) Patent No.: US 6,420,657 B1
(45) Date of Patent: Jul. 16, 2002

(54) CABLE IDENTIFICATION SYSTEM AND METHOD

(75) Inventors: Yung-Chin Fang, Round Rock; Tau Leng, Sugar Land; Jenwei Hsieh, Austin, all of TX (US)

(73) Assignee: Dell Products L.P., Round Rock, TX (US)

( * ) Notice: Subject to any disclaimer, the term of this patent is extended or adjusted under 35 U.S.C. 154(b) by 0 days.

(21) Appl. No.: 09/761,300

(22) Filed: Jan. 16, 2001

(51) Int. Cl.[7] ..... H01B 7/00
(52) U.S. Cl. ..... 174/112
(58) Field of Search ..... 174/112, 110 R; 116/200

(56) References Cited

U.S. PATENT DOCUMENTS 2,629,953 A * 3/1953 Stackelberg et al. ..... 174/112
3,474,559 A * 10/1969 Hunt ..... 174/112
5,489,275 A * 2/1996 Thompson et al. ..... 604/264

* cited by examiner

*Primary Examiner*—Chau N. Nguyen
(74) *Attorney, Agent, or Firm*—Haynes and Boone, LLP

(57) ABSTRACT

A cable identification system and method according to which one or more rings, having identifying indicia thereon, extend around the cable, and a cover extends around the ring and has a window formed therein, so that rotation of the ring relative to the cover exposes the identifying indicia.

14 Claims, 2 Drawing Sheets

CABLE IDENTIFICATION SYSTEM AND METHOD

BACKGROUND

The disclosures herein relate generally to an identification system and method for cables utilized in electronic installations.

In electronic installations, such as those that includes patch panels, hubs, switching apparatus, racks, or the like, a multitude of cables usually extend from the electronic components in the installation. Due to the high number of cables that often are identical or similar in appearance, the individual cables are hard to identify, locate, or trace. Although stickers, adhesive labels, and the like, have been placed on the cables, they are less than satisfactory since they tend to wear out, lose their adhesive properties, and often fall off the cables.

Accordingly, what is needed is a cable identification system and method according to which identifying indicia can be placed on cables easily and quickly, without the danger of it coming off.

SUMMARY

To this end, according to an embodiment of the disclosure, a cable identification system and method are provided according to which one or more rings, having identifying indicia thereon, extend around the cable, and a cover extends around the ring and has a window formed therein, so that rotation of the ring relative to the cover exposes the identifying indicia.

Significant advantages are achieved with the above embodiment since identifying indicia can be placed on cables easily and quickly, without the danger of it coming off.

DETAILED DESCRIPTION OF THE PREFERRED EMBODIMENT

Figure 1:
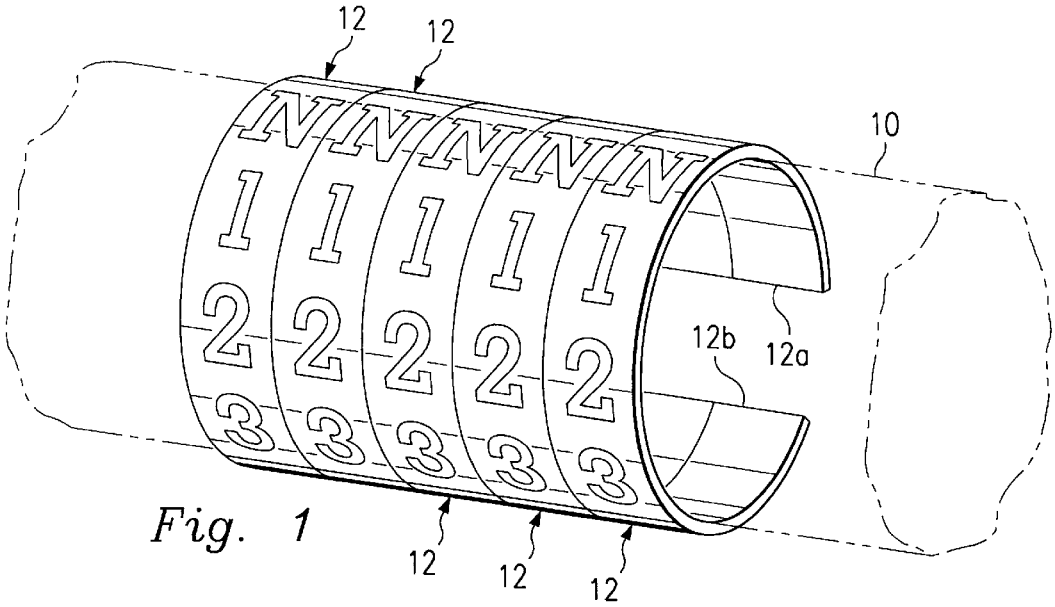
FIG. 1 is an isometric view of a component of the cable identification system according to one embodiment.

Referring to FIG. 1, the reference numeral 10 refers to a cable which is to be identified in accordance with an embodiment of the present disclosure. To this end, five identical split rings 12 are placed around the cable 10 in a side-by-side relationship. Each ring 12 is preferably manufactured of a firm plastic, such as nylon, and is split to form two slightly-spaced ends 12*a* and 12*b*. This enables the ends 12*a* and 12*b* of each ring 12 to be pulled apart and the ring placed around the cable 10, after which the ring 12 springs back around the cable under its inherent spring tension, as shown in FIG. 1. Each ring 12 has alpha-numeric indicia formed on its outer surface and extending around the circumference of the ring. In the example shown, the indicia is in the form of a series of circumferentially-spaced letters and numbers which are used, in a manner to be described, to identify the cable 10.

Figure 2:
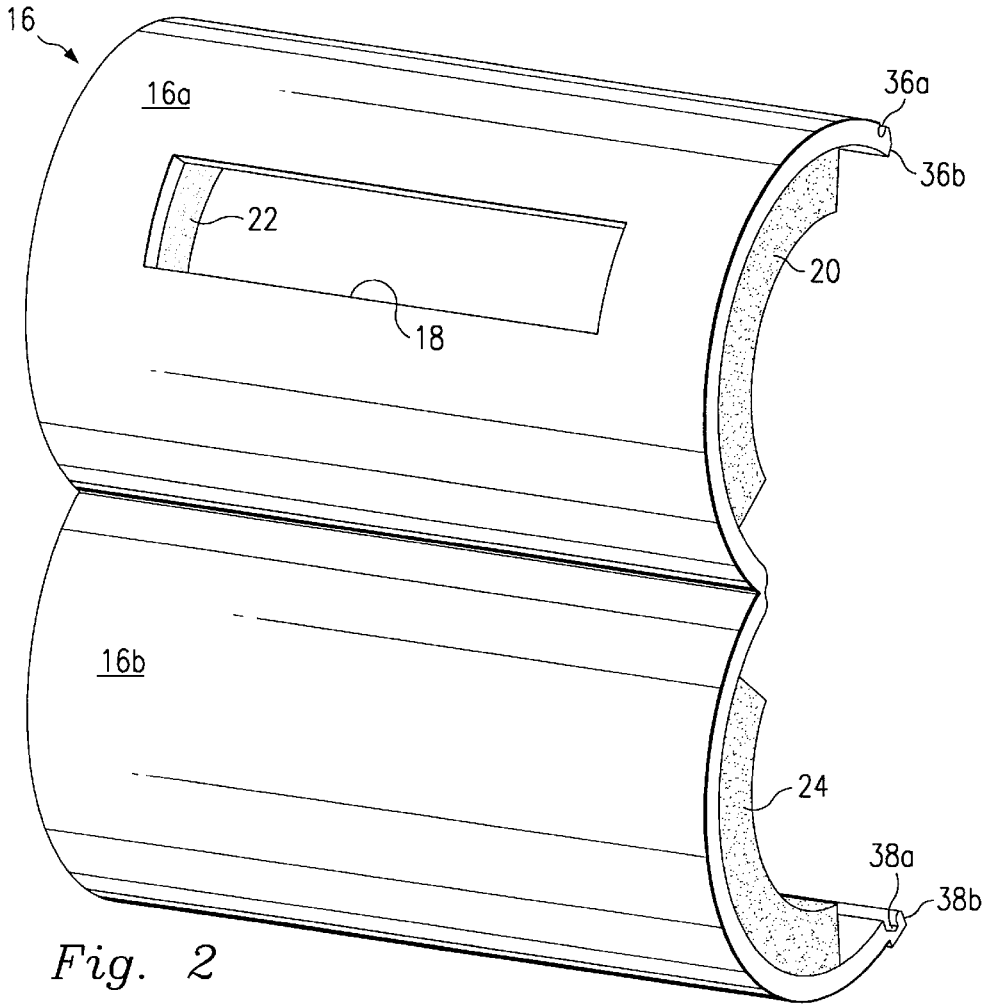
FIG. 2 is a front isometric view of another component of the cable identification system of FIG. 1.
Figure 3:
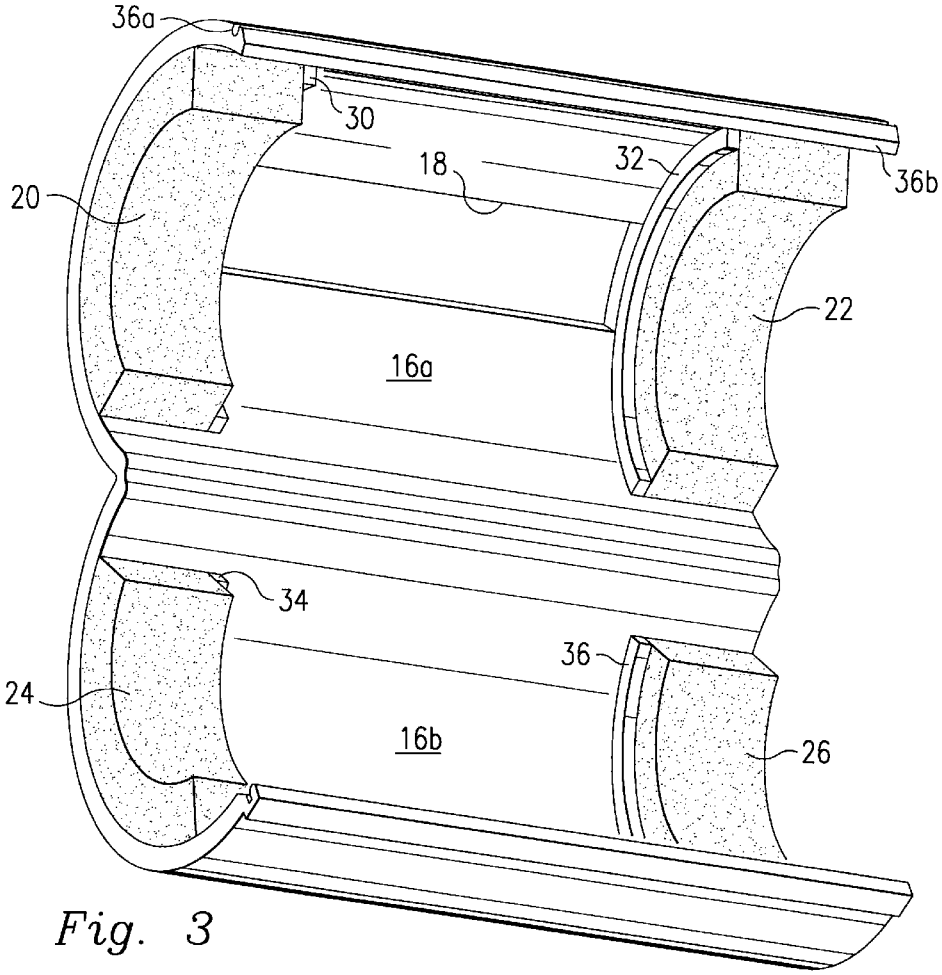
FIG. 3 is a rear isometric view of the component of FIG. 2

A cover cylinder 16 is shown in FIGS. 2 and 3 and is formed by two split, arcuate portions 16*a* and 16*b*. Each cylinder portion 16*a* and 16*b* is preferably manufactured of either a high impact plastic, such as ABS, or a relatively firm plastic, such as nylon. The junction between the two cylinder portions 16*a* and 16*b* is preferably of a reduced cross-section to form a hinge to permit the portions to be pivoted relative to each other from the opened position shown in FIGS. 2 and 3, to the closed position shown in FIG. 4. A window 18 is formed in the cylinder portion 16*a* and is sized to selectively expose one of the numerals or letters of each ring 12 in a manner to be described.

As better shown in FIG. 3, a pair of spaced retaining wings 20 and 22 are located on the inner surface of the cylinder portion 16*a,* and a pair of spaced retaining wings 24 and 26 are located on the inner surface of the cylinder portion 16*b*. Each wing 20, 22, 24 and 26 is arcuate in shape to conform to the inner surfaces of the cylinder portions 16*a* and 16*b,* and is preferably formed by a resilient material, such as rubber. One side wall of each wing 20, 22, 24 and 26 extends substantially flush with the corresponding end of the cylinder portions 16*a* and 16*b*. The wings 20, 22, 24, and 26 can be attached to their respective cylinder portions 16*a* and 16*b* in any conventional manner. A pair of spaced internal ribs 30 and 32 are formed on the internal surface of the cylinder portion 16*a,* and a pair of spaced internal ribs 34 and 36 are formed on the internal surface of the cylinder portion 16*b*. The ribs 30, 32, 34, and 36 are spaced from the corresponding ends of the cylinder portions 16*a* and 16*b* to maintain the corresponding wings 20, 22, 24 and 26 in the flush positions described above.

As shown in FIGS. 2 and 3, an axially-extending groove 36*a* is formed in the distal end portion of the cylinder portion 16*a* to form an adjacent tab 36*b,* and an axially-extending groove 38*a* is formed in the distal end portion of the cylinder portion 16*b* to form an adjacent tab 38*b*. The tabs 36*b* and 38*b* are sized relatively to the grooves 36*a* and 38*a* so that the tabs can be inserted in the respective grooves in a friction fit to permit the cylinder portions 16*a* and 16*b* to be locked in the closed position of FIG. 4, as will be described.

Figure 4:
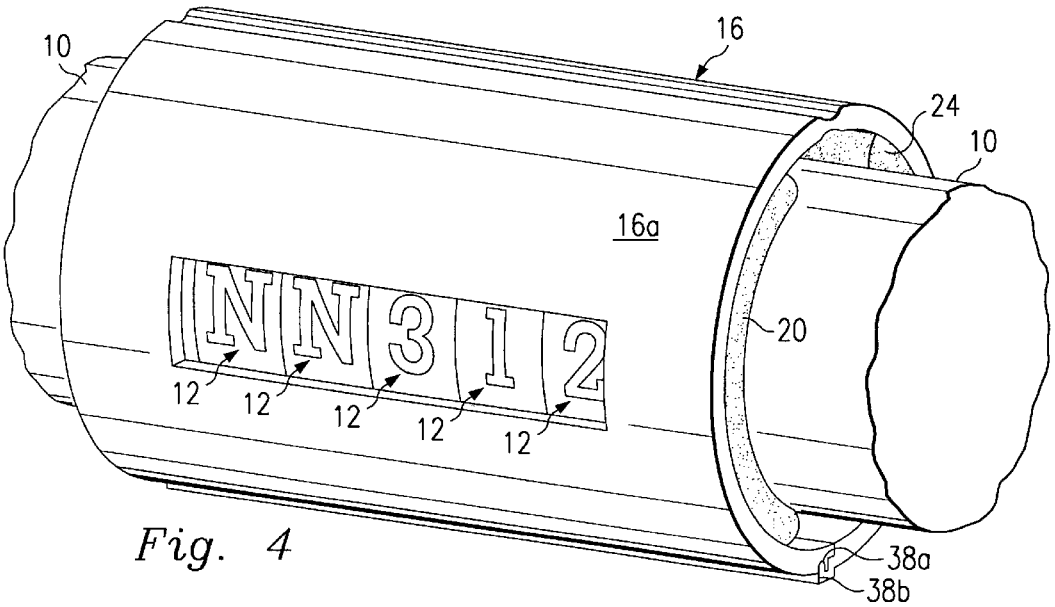
FIG. 4 is an isometric view depicting the components of FIGS. 1 and 2 in an assembled condition.

After the rings 12 have been installed over the cable 10 in the above manner, and as shown in FIG. 1, the cylinder portions 16*a* and 16*b* are placed proximate to the cable and pivoted from their open position shown in FIGS. 2 and 3 to their closed position shown in FIG. 4, in a manner to capture the cable 10 and the rings 12 within the cylinder 16. The tab 36*b* of the cylinder portion 16*a* is inserted in the groove 38*a* of the cylinder portion 16*b,* and the tab 38*b* of the cylinder portion 16*b* is inserted in the groove 36*a* of the cylinder portion 16*a,* to lock the cylinder portions in their closed position. In this closed position, the wings 20, 22, 24, and 26 engage corresponding portions of the cable 10, with the thicknesses of the wings being designed relative to the diameter of the cable so that the cable compresses the wings slightly to insure that the wings firmly grip the cable.

The design is such that, after the above installation, the diameter of each ring 12 is equal to, or slightly smaller than, the inner diameter of the cylinder 16. The above-mentioned spring tension of each ring 12 maintains it in position, yet permits a pin, or the like, to engage each ring and rotate it relative to the cylinder 16 and the cable 10 until the desired alpha-numeric indicia on each ring is exposed by the window 18. In this manner the cable 10 can be identified with five of alpha-numeric indicia corresponding to the number of rings 12.

Thus, identifying indicia can be permanently placed on cables easily and quickly, without the danger of the indicia falling off the cable. Also, the identifying indicia can easily be changed and the identifying system of the above embodiment can be easily removed and placed on another cable. Moreover, the resilient wings 20, 22, 24 and 26 will accommodate cables of different diameters.

It is understood that variations may be made in the foregoing without departing from the scope of the disclosed embodiment. For example, the number of rings 12 that are utilized can vary. Also, other techniques can be used to permit the relative pivotal movement between the cylinder portions 16*a* and 16*b*, such as, for example, the use of a separate hinge, or the like. Further, the mechanism disclosed above for locking the cylinders can vary. Also, spatial references, such as "inner", "outer", "over", "under", etc, are for the purpose of illustration only and do not limit the specific orientation or location of the structure described above.

Since other modifications, changes, and substitutions are intended in the foregoing disclosure, it is appropriate that the appended claims be construed broadly and in a manner consistent with the scope of the disclosed embodiment.

What is claimed is:

1. A system for identifying a cable, the system comprising:

at least one ring extending around the cable and adapted to be rotated relative to the cable;

identifying indicia formed on the ring;

a cover extending around the ring and having a window formed therein, so that rotation of the ring relative to the cover exposes the identifying idicia;

the identifying indicia being a series of alpha-numeric indicia spaced along the outer surface of the ring;

the series of alpha-numeric indicia being circumferentially spaced around the ring, the window exposing one of the series of indicia; and said at least one ring comprising a plurality of rings extending around the cable in a side-by-side relationship and the dimensions of the window being such that one of the series of indicia on each ring is exposed.

2. A system for identifying a cable, the system comprising:

at least one ring extending around the cable and adapted to be rotated relative to the cable;

identifying indicia formed on the ring;

a cover extending around the ring and having a window formed therein, so that rotation of the ring relative to the cover exposes the identifying indicia; and the cover being substantially cylindrical and including two arcuate portions adapted for pivotal movement relative to each other, between open and closed positions, so that they can be placed proximate to the cable and the ring, and moved from the open position to the closed position to capture the cable and the ring within the cover.

3. The system of claim 2 further comprising a locking mechanism for locking the arcuate portions in their closed position.

4. A system for identifying a cable, the system comprising:

at least one ring extending around the cable and adapted to be rotated relative to the cable;

identifying indicia formed on the ring;

a cover extending around the ring and having a window formed therein, so that rotation of the ring relative to the cover exposes the identifying indicia; and retaining members on the interior surface of the cover for engaging and gripping the cable.

5. The system of claim 4 wherein the retaining members are of a resilient material and the thicknesses of the retaining members relative to the diameter of the cable are such that the cable compresses the retaining members to insure that the retaining members grip the cable.

6. The system of claim 5 wherein the retaining members are arcuate wings disposed at end portions of the cover.

7. The system of claim 5 wherein the retaining members permit cables of different diameters to be identified.

8. A method for identifying a cable, the method comprising:

placing a plurality of rings around the cable in a side-by-side relationship;

providing identifying indicia on the rings, including a series of alpha-numeric indicia circumferentially spaced along the outer surface of the rings;

placing a cover around the rings;

providing a window on the cover for exposing one of the series of indicia; and rotating the rings relative to the cover so that the window selectively exposes one of the series of the identifying indicia.

9. A method for identifying a cable, the method comprising:

placing at least one ring around the cable;

providing identifying indicia on the ring;

placing a cover around the ring;

providing a window on the cover;

rotating the ring relative to the cover so that the window selectively exposes portions of the identifying indicia; and providing two arcuate portions adapted for pivot movement relative to each other between open and closed positions to form the cover.

10. The method of claim 9 further comprising:

placing the arcuate portions proximate to the cable and the ring; and moving the arcuate portions from the open position to the closed position to capture the cable and the ring within the cover.

11. The method of claim 10 further comprising locking the arcuate portions in their closed position.

12. A method for identifying a cable, the method comprising:

placing at least one ring around the cable;

providing identifying indicia on the ring;

placing a cover around the ring;

providing a window on the cover;

rotating the ring relative to the cover so that the window selectively exposes portions of the identifying indicia; and engaging and gripping the cable with retaining members on the cover.

13. The method of claim 12 further comprising;

forming the retaining members of a resilient material; and providing the retaining members with a thickness relative to the diameter of the cable so that the cable compresses the retaining members to insure that the retaining members grip the cable.

14. The method of claim 13 wherein the retaining members permit cables of different diameters to be identified.

* * * * *